US012144423B1

(12) United States Patent
Beacham

(10) Patent No.: US 12,144,423 B1
(45) Date of Patent: Nov. 19, 2024

(54) PROTECTIVE DEVICE FOR USE WITH FURNITURE FEET

(71) Applicant: Brandon Ray Beacham, Kill Devil Hills, NC (US)

(72) Inventor: Brandon Ray Beacham, Kill Devil Hills, NC (US)

( * ) Notice: Subject to any disclaimer, the term of this patent is extended or adjusted under 35 U.S.C. 154(b) by 0 days.

(21) Appl. No.: 18/615,812

(22) Filed: Mar. 25, 2024

(51) Int. Cl.
*A47B 91/06* (2006.01)

(52) U.S. Cl.
CPC ..... *A47B 91/06* (2013.01)

(58) Field of Classification Search
CPC ..... A47B 91/00; A47B 91/02; A47B 91/12; A47B 91/14; A47B 91/16; A47B 91/06; A47B 2091/063; B60B 33/00; B60B 2033/0034; B60B 2900/5112; B65G 7/02; A47C 7/002; A47C 7/008; A61H 3/0288; A61H 3/068
See application file for complete search history.

(56) References Cited

U.S. PATENT DOCUMENTS

| | | | | |
|---|---|---|---|---|
| 7,377,474 | B2 * | 5/2008 | Curtis | E01F 9/677 248/165 |
| 2004/0051014 | A1 * | 3/2004 | Keast | A47B 91/06 248/188.9 |
| 2007/0089266 | A1 * | 4/2007 | Beshore | A47B 91/16 16/42 R |
| 2008/0099639 | A1 * | 5/2008 | Webster | A47B 91/06 248/188.9 |
| 2008/0258023 | A1 * | 10/2008 | Desmarais | A47B 91/12 248/188.9 |
| 2011/0191985 | A1 * | 8/2011 | Hirth | A47B 91/12 16/42 R |
| 2012/0047688 | A1 * | 3/2012 | Belec | A47B 91/06 16/42 R |
| 2013/0117965 | A1 * | 5/2013 | Sievers | A47B 91/06 16/18 R |
| 2014/0106099 | A1 * | 4/2014 | Desmarais | A47C 7/002 428/36.1 |
| 2020/0000228 | A1 * | 1/2020 | Quintong | A47B 91/08 |
| 2021/0106136 | A1 * | 4/2021 | Bushey | A47B 91/14 |

FOREIGN PATENT DOCUMENTS

| | | | | |
|---|---|---|---|---|
| DE | 102005042170 | A1 * | 3/2007 | A47B 91/06 |
| DE | 202011004035 | U1 * | 6/2011 | A47B 91/06 |
| EP | 1224889 | A1 * | 7/2002 | A47B 91/12 |
| FR | 2711900 | A1 * | 5/1995 | A47B 91/06 |
| FR | 2947440 | A1 * | 1/2011 | A47B 91/06 |
| JP | 2015144712 | A * | 8/2015 | |

* cited by examiner

*Primary Examiner* — Chuck Y Mah
(74) *Attorney, Agent, or Firm* — Ashley D. Johnson; Dogwood Patent and Trademark Law

(57) ABSTRACT

The invention is a device that can be used to protect a support surface (such as flooring) from damage resulting from contact with a furniture foot. For example, the protective device can prevent scratches due to contact between a chair foot and hardwood flooring or tile when the chair is moved. The device includes a base that is permanently attached to each foot. The device also includes an insert that releasably nests within the base. The insert includes padding that acts as a barrier between the foot and any flooring, thereby preventing damage. In this way, the protective device protects flooring against abrasion from each foot portion of furniture.

20 Claims, 8 Drawing Sheets

PROTECTIVE DEVICE FOR USE WITH FURNITURE FEET

FIELD OF THE INVENTION

The presently disclosed subject matter is generally directed to a protective device for use with a wide variety of furniture feet to prevent damage between the furniture and any associated flooring.

BACKGROUND OF THE INVENTION

Furniture is widely used to support various human activities, such as sitting, eating, item storage, working, and sleeping. However, furniture tends to move or slide during use, resulting in scratches, scuffing, and other damage to any associated flooring. Protecting a floor from markings caused by contact with furniture has traditionally been accomplished through the use of adhesive felt or plastic pads applied to the underside of furniture feet. The adhesive pads serve as a barrier between the furniture and the flooring. While generally satisfactory for their purpose, conventional adhesive pads suffer from several drawbacks. For example, the bases of chair legs and other furniture feet come in a variety of different sizes and shapes that make attachment of the adhesive pads difficult. In addition, dirt or other debris commonly adheres to the adhesive portion of the pads, making them unsightly. The lifespan of the adhesive pads are also short, lasting a few weeks before the adhesive is no longer effective. Further, conventional adhesive pads are often misplaced as the adhesive fails, resulting in instability of the furniture. In addition, nail-on and screw-on coverings that attach to the underside of a chair foot have also been developed. However, these coverings must be replaced frequently and are only capable of being used a limited number of times (e.g., 25 the chair foot can only accommodate a small number of nail/screw holes). Further, drills and other tools must be present to replace the nail-on and screw-on coverings, which is not always convenient. It would therefore be beneficial to provide an improved device for preventing scratches and other damage resulting from contact between furniture feet and flooring.

SUMMARY OF THE INVENTION

The presently disclosed subject matter is directed to a protective device comprising a solid base and a downward extending lip. The base is defined by a top face and an opposed bottom face with a sidewall extending between the top face and bottom face. The lip is attached to an outer circumference of the bottom face of the base, extending downwardly and away from the bottom face of the base. The lip provides an interior space with an open bottom. The bottom face of the base comprises one or more attachments. The device also includes an insert defined by a solid coupler comprising a top face and an opposed bottom face, and an extending ridge positioned about an outer circumference of the coupler between the coupler top face and the coupler bottom face. The insert also includes a portion of padding positioned adjacent to the coupler bottom face. The coupler top face releasably contacts and attaches to the base attachments and the coupler ridge is positioned exterior to the lip interior space.

In some embodiments, the base includes at least one central aperture that spans the top and bottom faces of the base.

In some embodiments, the one or more attachments are magnets. The term "magnet" refers to a body having the property of producing a magnetic field external to itself. As such, the term magnet includes permanent magnets, electromagnets, and the like. The magnets can be constructed from any suitable material, such as iron, steel, alloy.

In some embodiments, the top face of the coupler comprises a layer or segment of metal. The metal can be selected from iron, steel, nickel, cobalt, and the like (e.g., any material that attracts a magnet).

In some embodiments, the one or more attachments are recessed within an interior of the seat.

In some embodiments, the height of the lip is the same as the height of the seat. In some embodiments, the height of the lip is about 5, 10, 15, 20, 25, 30, 35, 40, 45, or 50 percent less or greater than the height of the seat.

In some embodiments, the padding is selected from felt, woven fabric, knitted fabric, cloth, polytetrafluoroethylene (PTFE), polypropylene, polyethylene, rubber, nonwovens, foam, or combinations thereof.

In some embodiments, the padding has a thickness of about 0.1-0.5 inches.

In some embodiments, the presently disclosed subject matter is directed to a method of preventing direct contact between a furniture foot and flooring. Specifically, the method comprises permanently attaching the base of the protective device to a bottom surface of a furniture foot such that the base top face attaches to the bottom surface of the furniture foot. The method also includes releasably attaching the insert to the base by guiding coupler interior face into the lip interior until the coupler interior face contacts and attaches to the base attachments and the coupler ridge is positioned exterior to the lip interior space. The padding is positioned between the furniture foot and flooring, thereby preventing direct contact between the furniture foot and the flooring.

In some embodiments, the base is permanently attached using a mechanical element that passes through the central aperture that spans the top and bottom faces of the base.

In some embodiments, the insert is releasable from the base on demand.

In some embodiments, the insert is releasably attached to the base using mechanical attraction.

In some embodiments, the presently disclosed subject matter is directed to a kit comprising a plurality of bases and a plurality of inserts of the disclosed protective device. The bases and inserts are selected on demand.

DETAILED DESCRIPTION OF THE INVENTION

Figure 1A:
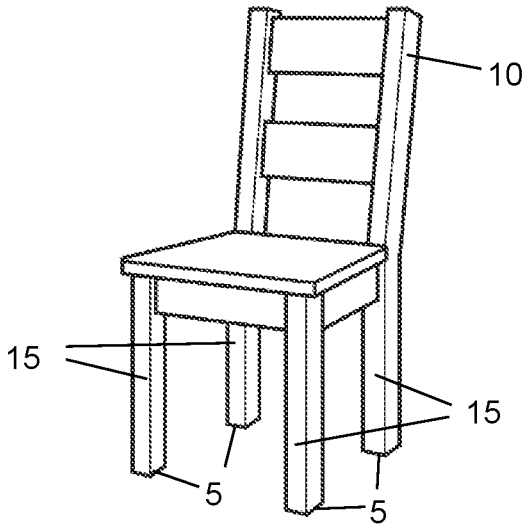
FIGS. 1*a* and 1*b* are perspective views of furniture comprising one or more legs and feet in accordance with some embodiments of the presently disclosed subject matter.

For the purpose of promoting an understanding of the principles of the present disclosure, reference will now be made to preferred embodiments and specific language will be used to describe the same. It will nevertheless be understood that no limitation of the scope of the disclosure is thereby intended, such alteration and further modifications of the disclosure as illustrated herein, being contemplated as would normally occur to one skilled in the art to which the disclosure relates.

Articles "a" and "an" are used herein to refer to one or to more than one (i.e., at least one) of the grammatical object of the article. By way of example, "an element" means at least one element and can include more than one element. It will be further understood that the terms "comprises," "comprising," "includes," and/or "including" when used herein specify the presence of stated features, integers, steps, operations, elements, and/or components, but do not preclude the presence or addition of one or more other features, integers, steps, operations, elements, components, and/or groups thereof.

Unless otherwise indicated, all numbers expressing quantities of components, conditions, and so forth used in the specification and claims are to be understood as being modified in all instances by the term "about." Accordingly, unless indicated to the contrary, the numerical parameters set forth in the instant specification and attached claims are approximations that can vary depending upon the desired properties sought to be obtained by the presently disclosed subject matter.

As used herein, the term "about", when referring to a value or to an amount of mass, weight, time, volume, concentration, and/or percentage can encompass variations of, in some embodiments +/−20%, in some embodiments +/−10%, in some embodiments +/−5%, in some embodiments +/−1%, in some embodiments +/−0.5%, and in some embodiments +/−0.1%, from the specified amount, as such variations are appropriate in the disclosed packages and methods. Thus, the term "about" is used to provide flexibility to a numerical range endpoint by providing that a given value may be "slightly above" or "slightly below" the endpoint without affecting the desired result.

As used herein, the term "and/or" includes any and all combinations of one or more of the associated listed items.

Relative terms such as "below" or "above" or "upper" or "lower" or "horizontal" or "vertical" may be used herein to describe a relationship of one element, layer, or region to another element, layer, or region as illustrated in the drawing figures. It will be understood that these terms and those discussed above are intended to encompass different orientations of the device in addition to the orientation depicted in the drawing figures.

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

All methods described herein can be performed in any suitable order unless otherwise indicated herein or otherwise clearly contradicted by context. The use of any and all examples, or exemplary language (e.g., "such as") provided herein, is intended merely to better illuminate the invention, and does not pose a limitation on the scope of the invention unless otherwise claimed. No language in the specification should be construed as indicating any unclaimed element as essential to the practice of the invention.

Unless otherwise defined, all technical terms used herein have the same meaning as commonly understood by one of ordinary skill in the art to which this disclosure belongs.

Figure 1B:
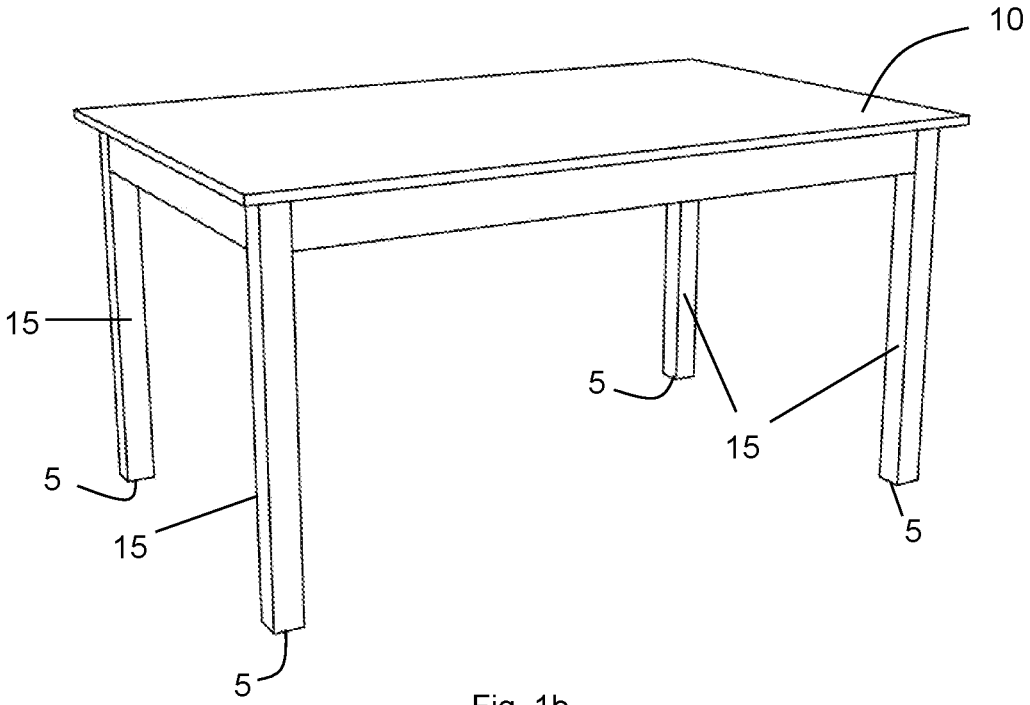

The presently disclosed subject matter is directed to a protective device that can be used to prevent direct contact between furniture feet and associated flooring. The term "furniture" broadly refers to moveable items commonly used in a house, office, etc. Suitable items of furniture can therefore include (but are not limited to) tables, chairs, couches, desks, cabinets, stools, beds, bookcases, consoles, TV stands, benches, ottomans, nightstands, and the like. As described in detail below, the disclosed protective assembly is suitable for use with furniture that includes one or more feet. The term "foot" refers to the bottom-most surface of an article of furniture. As illustrated FIGS. 1*a* and 1*b*, foot 5 is positioned at the distal end of leg 15 of furniture 10.

Figure 2:
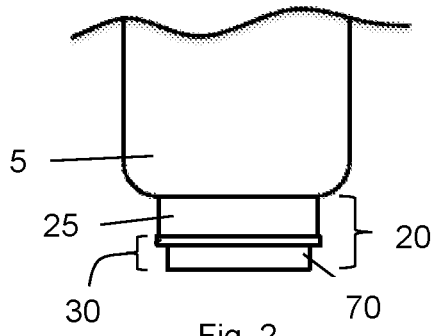
FIG. 2 is a front plan view of a protective device positioned on a furniture foot in accordance with some embodiments of the presently disclosed subject matter.

The disclosed device can be used to protect a support surface (such as flooring) from damage resulting from contact with foot 5. For example, the protective device can prevent scratches due to contact between a chair foot and hardwood flooring or tile when the chair is moved. FIG. 2 illustrates one embodiment of device 20 positioned on foot 5 of a piece of furniture. As shown, the device includes base 25 that is permanently attached to foot 5. The device also includes insert 30 that releasably nests within the base. The insert includes padding 70 that acts as a barrier between foot 5 and any flooring, thereby preventing damage. In this way, the protective device protects flooring against abrasion from the foot portion of furniture 10.

Figure 3A:
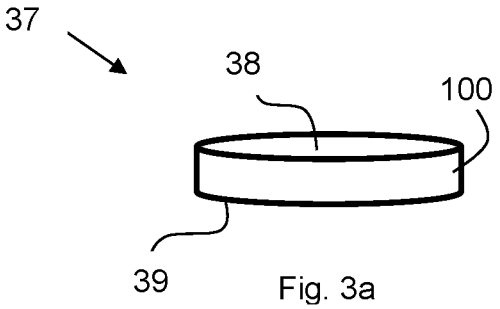
FIG. 3*a* is a perspective view of a base seat in accordance with some embodiments of the presently disclosed subject matter.

As noted, the protective device includes a base that is attached to the bottom surface of a furniture foot. The base includes a seat that directly contacts foot 5 and a lip that extends downwardly from the seat. FIG. 3*a* illustrates one embodiment of seat 37 comprising top face 38 that is configured to directly contact foot 5 and opposed bottom face 39. Sidewall 100 extends between the top and bottom faces. In some embodiments, the seat can be configured in a cylindrical shape, although any shape can be used.

Figure 3B:
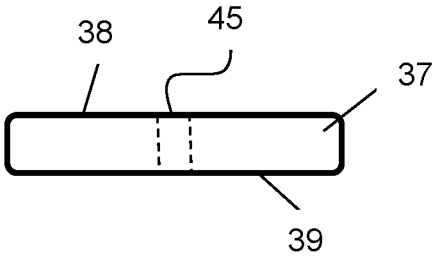
FIG. 3*b* is a side plan view of a base seat in accordance with some embodiments of the presently disclosed subject matter.
Figure 3C:
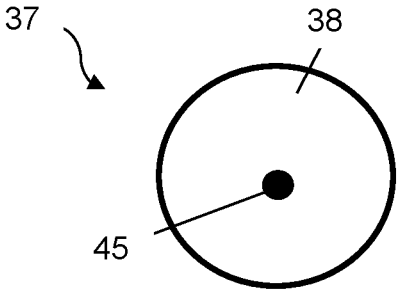
FIG. 3*c* is a top plan view of a base comprising an aperture in accordance with some embodiments of the presently disclosed subject matter.
Figure 3D:
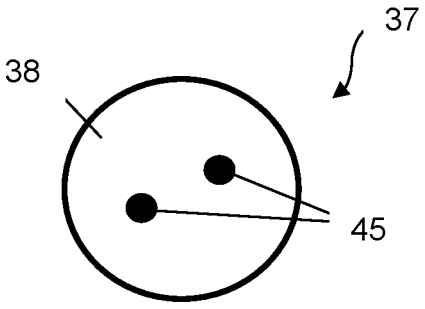
FIG. 3*d* is a top plan view of a base comprising a plurality of apertures in accordance with some embodiments of the presently disclosed subject matter.

The base is permanently attached to foot 5 using any suitable mechanism. For example, welding, adhesives, and mechanical elements (e.g., screws, nails) can be used. In some embodiments, seat 37 can include one or more apertures 45 to facilitate attachment to the foot, as shown in FIGS. 3*b* and 3*c*. The term "aperture" refers to any type of opening, such as a hole, gap, slit, or cleft in any form or shape. A nail, screw, or other similar elongated securing element can be inserted through the aperture of the seat and into the furniture foot to secure the base. In some embodiments, the aperture can be countersunk to accept the head of a screw or nail. Seat 37 can include any number of apertures, such as a single aperture positioned in the approximate center of the seat, or multiple apertures as shown in FIG. 3*d*.

Figure 4A:
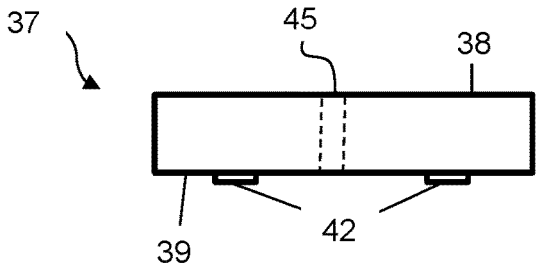
FIG. 4*a* is a side plan view of a base seat in accordance with some embodiments of the presently disclosed subject matter.
Figure 4B:
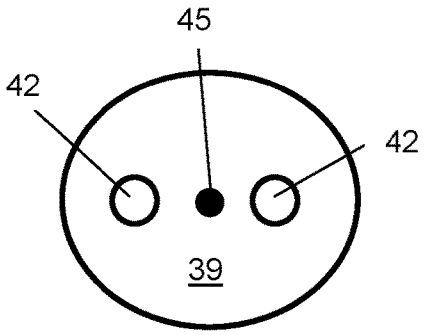
FIG. 4*b* is a bottom plan view of a base seat in accordance with some embodiments of the presently disclosed subject matter.

Bottom face 39 of the seat can also include one or more attachments 42 that facilitate coupling with insert 30. The term "attachment" refers to any element that allows base 25 to be releasably coupled to insert 30. Suitable attachment elements can include, for example, one or more magnets, as shown in FIGS. 4*a* and 4*b*. Any number of attachments can be used (e.g., 1, 2, 3, or more). Thus, magnetic attraction between attachment 42 and a metal component included on the insert allow for removable coupling of the two elements.

Figure 4C:
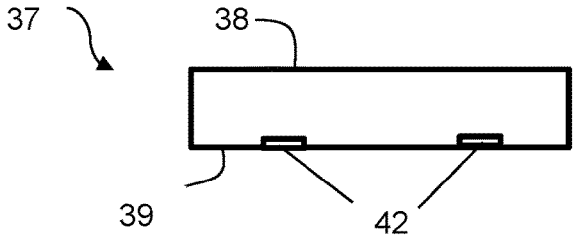
FIG. 4*c* is a side plan view of a base seat with recessed magnets in accordance with some embodiments of the presently disclosed subject matter.

In some embodiments the attachments (e.g., magnets) can be recessed within the interior of the seat, adjacent to bottom face 39, as shown in FIG. 4*c*. In this way, the base and insert can directly contact each other when the device is assembled. The term "recessed" includes a structure embedded in a support.

Figure 5A:
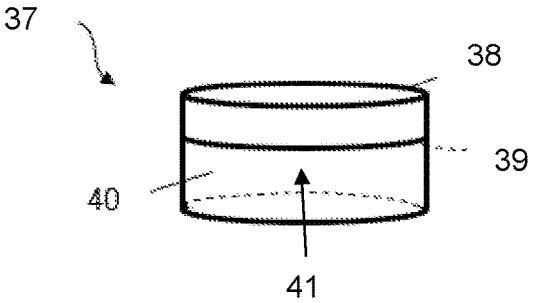
FIG. 5*a* is a perspective view of a device base comprising a seat and a lip in accordance with some embodiments of the presently disclosed subject matter.
Figure 5B:
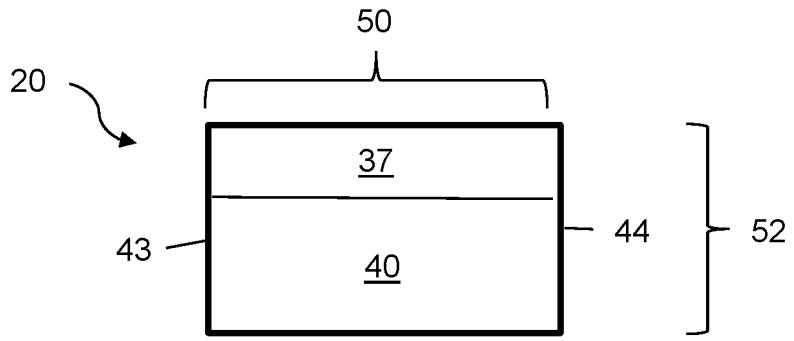
FIG. 5*b* is a cross-sectional view of a device base in accordance with some embodiments of the presently disclosed subject matter.

The base also include lip 40 extending downwardly and away from bottom face 39, as illustrated in FIGS. 5*a* and 5*b*. The lip provides a recessed interior 41 for housing a portion of the insert as described below. The lip is disposed adjacent to the outer peripheral edge of lower face 39 of the seat.

Figure 5C:
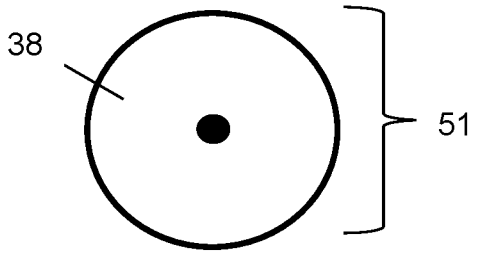
FIG. 5*c* is a top plan view of a device base in accordance with some embodiments of the presently disclosed subject matter.

The base can be configured in a variety of sizes, such as to cooperate with a chair foot as well as a relatively larger sofa foot. For example, the base can include length 50 and width 51 of about 0.5-5 inches (e.g., at least/no more than about 0.5, 1, 2, 3, 4, or 5 inches). The term "length" refers to the longest horizontal distance of the base (e.g., between side edges 43, 44). The term "width" refers to the longest straight line distance perpendicular to the length (from a front edge to a rear edge), as shown in FIG. 5*c*. The base can also include height 52 (e.g., the distance between base top face 38 and a bottom edge of lip 40) of about 0.5-5 inches (e.g., at least/no more than about 0.5, 1, 2, 3, 4, or 5 inches). It should be appreciated that the base is not limited and can be configured with a length, width, and height outside the given ranges.

The height of the lip can be about the same as the height of the seat (e.g., each about 0.5 inches). However, the height of the lip can be greater or less than the height of the seat in some configurations (e.g., about 10, 20, 30, 40, 50, 60, 70, 80, 90, 100, 150, 200, 250, or 300 percent greater or less).

The base can have any desired cross-sectional shape, such as (but not limited to) circular, oval, square, rectangular, and the like.

Base 25 can be constructed from any suitable rigid material(s). The term "rigid" refers to a material that is capable of holding or retaining its original shape after a force of pressure has been applied to it. Suitable rigid materials can include (but are not limited to) metal (e.g., stainless steel, steel, aluminum, titanium), wood, hard plastic, plexiglass, composites, and combinations thereof.

Figure 6A:
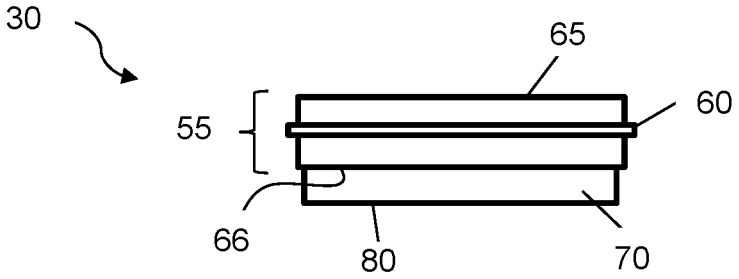
FIG. 6*a* is a front plan view of a device coupler in accordance with some embodiments of the presently disclosed subject matter.
Figure 6B:
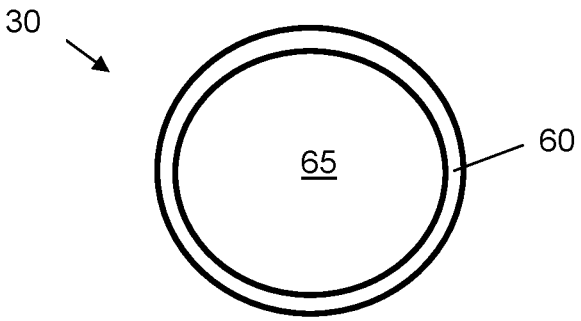
FIG. 6*b* is a top plan view of a device coupler in accordance with some embodiments of the presently disclosed subject matter.

As noted above, the disclosed protective device also includes insert 30 that cooperates with the base. As illustrated in FIGS. 6*a* and 6*b*, the insert includes coupler 55 that is sized and shaped to partially fit within the interior of lip 40 of the base. The coupler includes ledge 60 with a diameter that is larger than the diameter of the lip interior, acting as a stop to properly position the insert into position with the base. When the insert is connected to the base, insert top face 65 is in direct contact with bottom face 39 of the base. In some embodiments, the insert top face can include a metal material, allowing for magnetic attraction to hold the insert in place adjacent to the bottom face of the base. Specifically, the metallic top face of the insert is held in place due to the attractive forces applied by attachments 42 (e.g., magnets). However, the presently disclosed subject matter is not limited to magnetic attraction between the base and the insert and any releasable connection can be used (e.g., clips, fasteners, snap-fit arrangement, and the like).

Figure 6C:
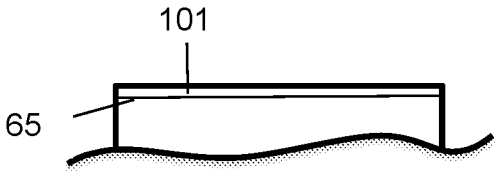
FIG. 6*c* is a fragmentary side plan view of an insert in accordance with some embodiments of the presently disclosed subject matter.
Figure 6D:
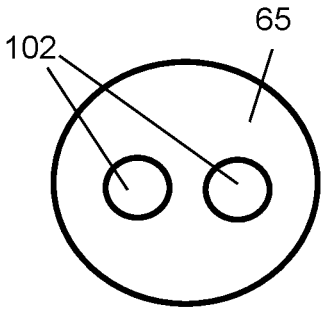
FIG. 6*d* is a top plan view of the top face of an insert in accordance with some embodiments of the presently disclosed subject matter.

In some embodiments, the top face of the coupler can include a layer of metal 101, as shown in FIG. 6*c*. In other embodiments, the top face of the coupler can include segments or regions of metal 102 that are positioned to overlay with attachments on the base, as shown in FIG. 6*d*.

The insert includes padding 70 that extends from bottom face 66 of the coupler. The term "padding" broadly refers to any material that will not scratch or damage flooring and/or a material that serves to provide cushioning to a chair foot bottom surface. Thus, the padding can include felt, woven or knitted fabric or cloth, scratch-resistant material such as polytetrafluoroethylene (PTFE), polypropylene or polyethylene, or other resilient materials such as rubber, nonwovens, and foam. The felt, cloth, and nonwovens may be made using any size fibers or fibers made from any material known in the art. Fibers used in felt or nonwovens may be derived from biological sources such as linen or wool. Felt or nonwovens may be made using synthetic fibers including but not limited to polyethylene terephthalate (PET), polyethylene, polypropylene, nylon, or other polyesters. Felt or nonwovens made from biological sources may also be used either alone or in combination with other fibers made from synthetic materials such as polyethylene, polypropylene, polyethylene terephthalate (PET), nylon, or other polyester fibers. The fibers may or may not be reinforced using additives such as microspheres or polymer resin or reinforced using thermal treatments.

Padding 70 is therefore constructed from a protective material adapted to prevent wear on flooring and/or distance a foot bottom surface from the ground. The padding is configured to lie between a furniture leg and the floor to prevent scratching or wear on the floor as the furniture rests or moves along the floor surface.

Figure 7:
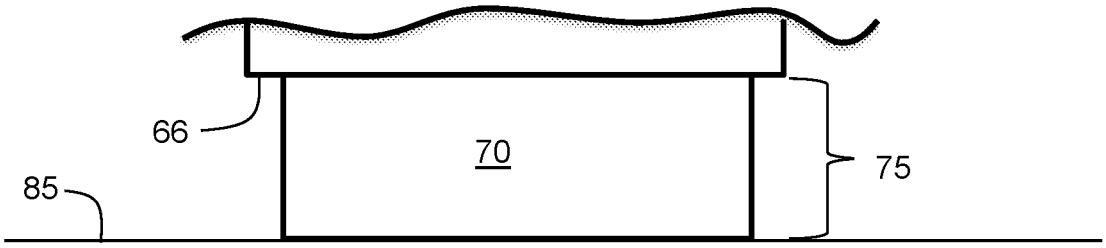
FIG. 7 is a side plan view of device padding contacting a support surface in accordance with some embodiments of the presently disclosed subject matter.

Padding 70 can have a thickness 75 of about 0.1-1 inches (e.g., at least/no more than about 0.1, 0.2, 0.3, 0.4, 0.5, 0.6, 0.7, 0.8, 0.9, or 1 inch) as shown in FIG. 7. The thickness of the padding is the longest vertical distance between coupler bottom face 66 and bottom face 80 of the padding that is in contact with flooring 85. It should be appreciated that the thickness of the padding can decrease over time, as the furniture is being used. Specifically, the padding can be worn down as the furniture is used and/or moved. Once the padding thickness has substantially decreased, a user can replace the coupler as discussed below.

The coupler can be constructed from any suitable rigid material, such as (but are not limited to) metal, wood, hard plastic, plexiglass, composites, and combinations thereof.

In some embodiments, the padding can have a generally circular or disc shape. However, the shape of the padding is not particularly limited and can include any suitable shape or combination of shapes.

The insert can have any desired cross-sectional shape, such as (but not limited to) circular, oval, square, rectangular, and the like.

Figure 8A:
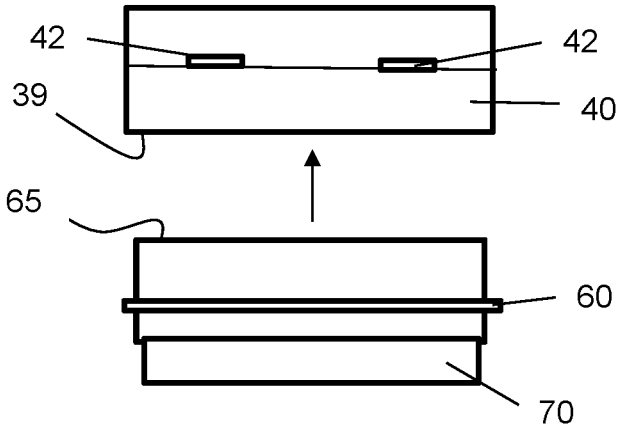
FIGS. 8*a* and 8*b* illustrate attachment of a coupler to a base in accordance with some embodiments of the presently disclosed subject matter.
Figure 8B:
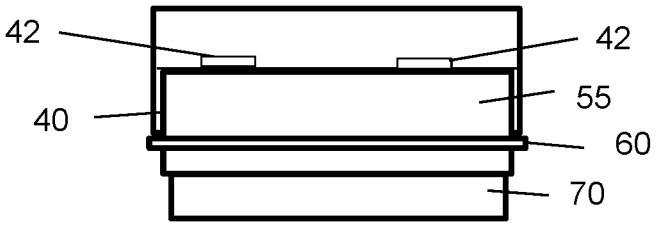

The base and the coupler can be releasably attached together to form device 20. As shown in FIG. 8*a*, top face 65 of the coupler is advanced towards bottom face 39 of the base, within the recessed interior of lip 40. Attraction between attachment 42 and the top face of coupler allows the base and coupler to be releasably joined together, as shown in FIG. 8*b*. Ridge 60 acts as a stop and prevents further advancement of the base into the interior of the lip. Specifically, the length of the ledge is larger than the length of the interior of the lip (e.g., at least about 1, 5, 10, 15, 20, 25, or 30 percent larger). In this way, only the top portion of the coupler is positioned within the lip interior, such that the top face of the coupler contacts the bottom face of the base.

When a user desires to detach the coupler from base 25, a light pressure can be applied to release the attraction, allowing the coupler to be easily removed from the interior of the base lip. A new coupler can then be positioned on the base as described herein.

Figure 9A:
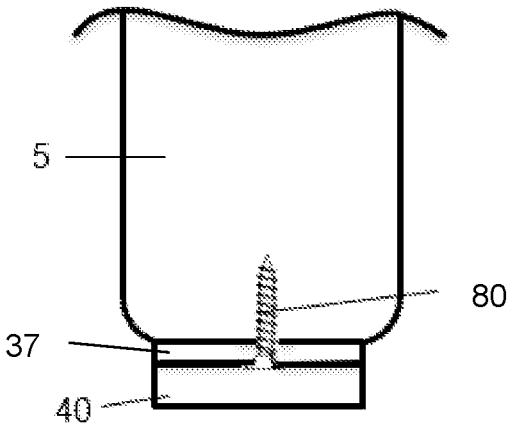
FIGS. 9*a*-9*c* are side plan views that illustrate one method of using the protective device in accordance with some embodiments of the presently disclosed subject matter.

In use, base 20 can be permanently attached to a bottom surface of furniture foot 5. As noted above, any method can be used, such as the use of adhesives, welding, and the like. For example, in some embodiments a mechanical element (such as screw 80) can be advanced through aperture 45 of the base seat and into foot 5 to secure the base in position, as shown in FIG. 9*a*. The base is then permanently attached to the furniture foot, with seat 37 positioned to contact the bottom-most surface of foot 5. Lip 40 extends downwardly from the seat, as illustrated.

Figure 9B:
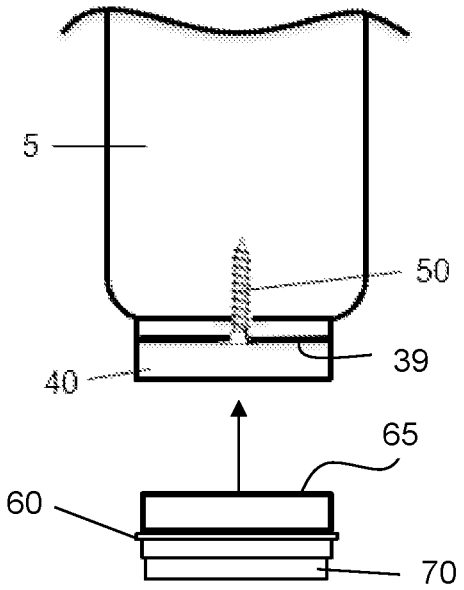
Figure 9C:
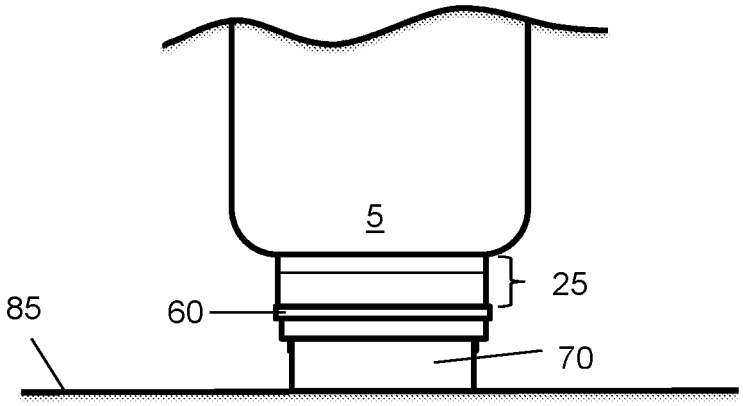

Insert 30 is then advanced into the interior of the lip such that top face 65 of the insert contacts bottom face 39 of the base, as shown in FIG. 9*b*. In this way, attraction between attachment 42 and the top face of the insert releasably couples the base and insert together. Once attached, padding 70 is positioned to contact flooring, thereby preventing direct contact between the chair foot and the floor, as shown in FIG. 9*c*. In this way, scratches and scuffing are prevented. The process can be repeated for each foot on an item of furniture. The furniture can then be used and moved without damaging any associated flooring.

As the padding becomes worn from use, the coupler can be released from attachment with the base by providing light pressure. A new coupler with fresh padding 70 can then be joined to the base as discussed above.

Figure 10:
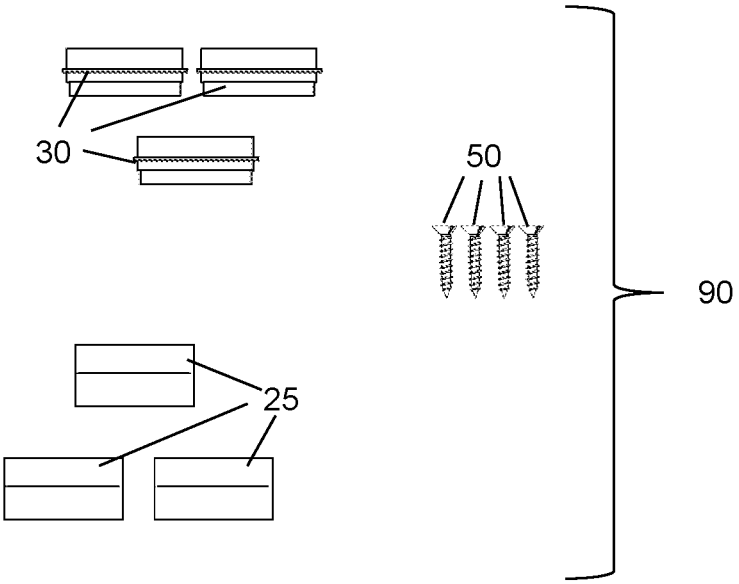
FIG. 10 illustrates a kit in accordance with some embodiments of the presently disclosed subject matter.

As shown in FIG. 10, the disclosed protective device can be provided as a modular kit 90 of inserts, bases, and optionally any associated hardware (e.g., screws, nails), allowing the user to select the precise number pad bases and/or replacement inserts needed for a given application. The kit may include any number of inserts with padding of the same or different thicknesses. The modular kit can allow a user to replace worn or sullied padding with a new insert.

The disclosed protective device includes many advantages over prior protective systems. For example, device 20 is easy to use and replace such that even children or the elderly can enjoy the benefits.

As noted above, the protective device minimizes or eliminates damage to any underlying floor caused by contact with the foot of a piece of furniture.

The disclosed device provides a financial benefit to users, preventing the costly replacement of damaged flooring.

The device can be supplied as an original component with new furniture or can be easily retrofitted to an existing furniture item.

Device 20 can be adapted for use with a variety of furniture feet, from large couches to small dining chairs.

Padding 70 allows the device to withstand compressive forces exerted through use (e.g., sitting in a chair, moving a couch) without damage to the underlying flooring.

Padding 70 also lessens any noise produced when a furniture item is moved, especially upon wooden or other hard surfaces.

The disclosed device advantageously includes removable padding that can be quickly and easily removed when worn.

Device 20 is relatively simple, reliable, and inexpensive to produce.

The foregoing description has been set forth merely to illustrate the invention and is not intended to be limiting. Each of the disclosed aspects and embodiments of the invention may be considered individually or in combination with other aspects, embodiments, and variations of the invention. In addition, unless otherwise specified, the steps of the methods of the invention are not confined to any particular order of performance. Modifications of the disclosed embodiments incorporating the spirit and substance of the invention may occur to persons skilled in the art, and such modifications are within the scope of the invention.

What is claimed is:

1. A protective device comprising:

a solid base defined by:

a seat comprising a planar top face and an opposed planar bottom face, with a sidewall extending between the top face and bottom face, the sidewall including a consistent height between the top face and bottom face of the seat;

a lip attached to and extending around an entire outer circumference of the bottom face of the seat, extending downwardly and away from the bottom face of the seat, the lip providing an interior space with an open bottom;

wherein the bottom face of the seat comprises one or more attachments;

an insert defined by:

a solid coupler comprising a planar top face and an opposed bottom face, and an extending ledge positioned about an outer circumference of the coupler between the coupler top face and the coupler bottom face;

wherein the top face of the solid coupler comprises a length that is equal to a length of the bottom face of the solid coupler, and wherein the ledge comprises a length that is greater than the length of the bottom face and top face of the solid coupler;

a portion of padding positioned adjacent to the coupler bottom face;

wherein the coupler top face releasably contacts and attaches to the seat attachments and the coupler ledge and coupler bottom face are positioned exterior to the lip interior space.

2. The protective device of claim 1, wherein the seat includes at least one central aperture that spans the top and bottom faces of the seat.

3. The protective device of claim 1, wherein the one or more attachments are magnets.

4. The protective device of claim 3, wherein the top face of the coupler comprises a layer or segment of metal.

5. The protective device of claim 1, wherein the one or more attachments are recessed within an interior of the seat.

6. The protective device of claim 1, wherein the height of the lip is the same as the height of the seat.

7. The protective device of claim 1, wherein the height of the lip is about 5, 10, 15, 20, 25, 30, 35, 40, 45, or 50 percent less or greater than the height of the seat.

8. The protective device of claim 1, wherein the padding is selected from felt, woven fabric, knitted fabric, cloth, polytetrafluoroethylene (PTFE), polypropylene, polyethylene, rubber, nonwovens, foam, or combinations thereof.

9. The protective device of claim 1, wherein the padding has a thickness of about 0.1-0.5 inches.

10. A method of preventing direct contact between a furniture foot and flooring, the method comprising:

permanently attaching the base of the protective device of claim 1 to a bottom surface of a furniture foot such that the seat top face attaches to the bottom surface of the furniture foot;

releasably attaching the insert to the base by guiding the coupler top face into the lip interior space of the lip until the coupler top face contacts and attaches to the one or more base attachments and the coupler ledge is positioned exterior to the lip interior space;

whereby the padding is positioned between the furniture foot and flooring, thereby preventing direct contact between the furniture foot and the flooring.

11. The method of claim 10, wherein the furniture is selected from one or more tables, chairs, couches, desks, cabinets, stools, beds, bookcases, consoles, TV stands, benches, ottomans, or nightstands.

12. The method of claim 10, wherein the base is permanently attached using a mechanical element that passes through a central aperture that spans the top and bottom faces of the base.

13. The method of claim 10, wherein the insert is releasable from the base on demand.

14. The method of claim 10, wherein the insert is releasably attached to the base using mechanical attraction.

15. The method of claim 10, wherein the base includes at least one central aperture that spans the top and bottom faces of the base.

16. The method of claim 10, wherein the one or more attachments are magnets.

17. A kit comprising:

a plurality of bases of the protective device of claim 1; and a plurality of inserts of the protective devices;

wherein the bases and inserts are selected on demand.

18. The kit of claim 17, further comprising attachment hardware selected from a plurality of nails, screws, or combinations thereof.

19. The kit of claim 18, wherein the base includes at least one central aperture that spans the top and bottom faces of the base.

20. The kit of claim 18, wherein the one or more attachments are magnets.

* * * * *